US009281158B2

(12) United States Patent
Ogura et al.

(10) Patent No.: US 9,281,158 B2
(45) Date of Patent: Mar. 8, 2016

(54) X-RAY EMITTING TARGET AND X-RAY EMITTING DEVICE

(75) Inventors: Takao Ogura, Yokohama (JP); Yasue Sato, Machida (JP); Nobuhiro Ito, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/124,216

(22) PCT Filed: May 28, 2012

(86) PCT No.: PCT/JP2012/003474

§ 371 (c)(1), (2), (4) Date: Dec. 5, 2013

(87) PCT Pub. No.: WO2012/169141

PCT Pub. Date: Dec. 13, 2012

(65) Prior Publication Data

US 2014/0112450 A1 Apr. 24, 2014

(30) Foreign Application Priority Data

Jun. 7, 2011 (JP) ..... 2011-127513

(51) Int. Cl.

| | |
|---|---|
| ***H01J 35/12*** | (2006.01) |
| ***H01J 35/18*** | (2006.01) |
| ***H01J 35/08*** | (2006.01) |
| | ***H01J 35/16*** |
| (2006.01) | *H05G 1/06* |
| (2006.01) | |

(Continued)

(52) U.S. Cl.

CPC ..... *H01J 35/12* (2013.01); *H01J 35/08* (2013.01); *H01J 35/16* (2013.01); *H01J 35/18* (2013.01); *H01J 2235/081* (2013.01); *H01J 2235/084* (2013.01); *H01J 2235/087* (2013.01); *H01J 2235/1291* (2013.01); *H01J 2235/16* (2013.01); *H01J 2235/186* (2013.01); *H05G 1/06* (2013.01)

(58) Field of Classification Search

CPC ..... H01J 2235/084; H01J 2235/1204; H01J 2235/081; H01J 2235/085; H01J 2235/088; H01J 2235/1241; H01J 2235/1262; H01J 2235/1291; H01J 35/08; H01J 35/10; H01J 35/105; H01J 35/12; H01J 2235/087; H01J 2235/16; H01J 2235/186; H01J 35/16; H01J 35/18; B23K 1/0008; B23K 35/32; H05G 1/06

USPC ..... 378/121, 143

See application file for complete search history.

(56) References Cited

U.S. PATENT DOCUMENTS

| | | | | |
|---|---|---|---|---|
| 6,850,598 | B1 * | 2/2005 | Fryda | H01J 35/10 378/140 |
| 7,359,487 | B1 | 4/2008 | Newcome | |

FOREIGN PATENT DOCUMENTS

| | | | |
|---|---|---|---|
| EP | 1580787 | A2 | 9/2005 |
| EP | 2048689 | A1 | 4/2009 |
| JP | H04-144045 | A | 5/1992 |
| JP | 2000306533 | A | 11/2000 |
| JP | 2003505845 | A | 2/2003 |

* cited by examiner

*Primary Examiner* — Irakli Kiknadze

(74) *Attorney, Agent, or Firm* — Canon U.S.A. Inc., IP Division

(57) ABSTRACT

An X-ray emitting target including a diamond substrate, a first layer disposed on the diamond substrate and including a first metal, and a second layer disposed on the first layer and including a second metal whose atomic number is 42 or more and which has a thermal conductivity higher than that of the first metal. Carbide of the first metal is present at a boundary between the diamond substrate and the first layer. The target is prevented from overheating, so that output variation due to rising temperature is suppressed. Thus it is possible to emit stable and high output X-rays.

7 Claims, 6 Drawing Sheets

X-RAY EMITTING TARGET AND X-RAY EMITTING DEVICE

TECHNICAL FIELD

The present invention relates to an X-ray emitting target and an X-ray emitting device, in particular to a transmission type X-ray emitting target and an X-ray emitting device using the transmission type X-ray emitting target, which can be applied to diagnostic application and non-destructive X-ray imaging in the medical equipment field and the industrial equipment field.

BACKGROUND ART

As an X-ray emitting target, a transmission type target is publicly known. In the transmission type target, an electron emission source and an extraction window can be arranged on a straight line, so that the transmission type target is expected to be applied to a small-sized X-ray emitting device.

PTL 1 discloses that when a tungsten anode is formed on a diamond substrate, an adhesion promoting layer is disposed as an intermediate layer between the anode and the diamond substrate. PTL 2 discloses that when a tungsten anode is formed on a beryllium substrate, an intermediate layer of copper, chromium, iron, titanium, or the like is disposed between the anode and the beryllium substrate in order to prevent peeling due to stress caused by the difference between the linear expansion coefficients.

CITATION LIST

Patent Literature

PTL 1: PCT Japanese Translation Patent Publication No. 2003-505845

PTL 2: Japanese Patent Laid-Open No. 2000-306533

SUMMARY OF INVENTION

Technical Problem

A transmission type target including a diamond substrate has an advantage of good heat dissipation properties because of unique physical properties of diamond, such as low density (atomic number Z=6), high thermal conductivity (lambda=1E3 to 2E3 W/mK), and high thermostability (melting point is 3550 degrees Celsius). However, even when a transmission type X-ray target includes a diamond substrate, localized heat generation in the target is not necessarily sufficiently delocalized, that is, heat transfer properties from a heat generating portion of the anode of the target to the diamond substrate is not necessarily sufficient. Therefore, variation (output variation) of emission intensity of X-rays emitted from the target may occur. It is important to suppress the output variation and perform stable and high output operation in order to enhance sensitivity and performance of an X-ray analysis system that uses an X-ray target.

Solution to Problem

A first X-ray emitting target of the present invention includes a diamond substrate, a first layer disposed on the diamond substrate and including a first metal, and a second layer disposed on the first layer and including a second metal whose atomic number is 42 or more and which has a thermal conductivity higher than that of the first metal. Carbide of the first metal is present at a boundary between the diamond substrate and the first layer.

A second X-ray emitting target of the present invention includes a diamond substrate, a first layer disposed on the diamond substrate and including a first metal where a standard free energy of formation of carbide in a temperature range from 500 degrees Celsius to 1500 degrees Celsius is negative, and a second layer disposed on the first layer and including a second metal whose atomic number is 42 or more and which has a thermal conductivity higher than that of the first metal.

Advantageous Effects of Invention

According to the present invention, it is possible to provide an X-ray emitting target and an X-ray emitting device, which have excellent heat transfer characteristics between the diamond substrate and the target layer (anode), suppresses output variation due to rising temperature of the target layer, and have stable and high output X-ray emission characteristics.

DESCRIPTION OF EMBODIMENT

Figure 1:
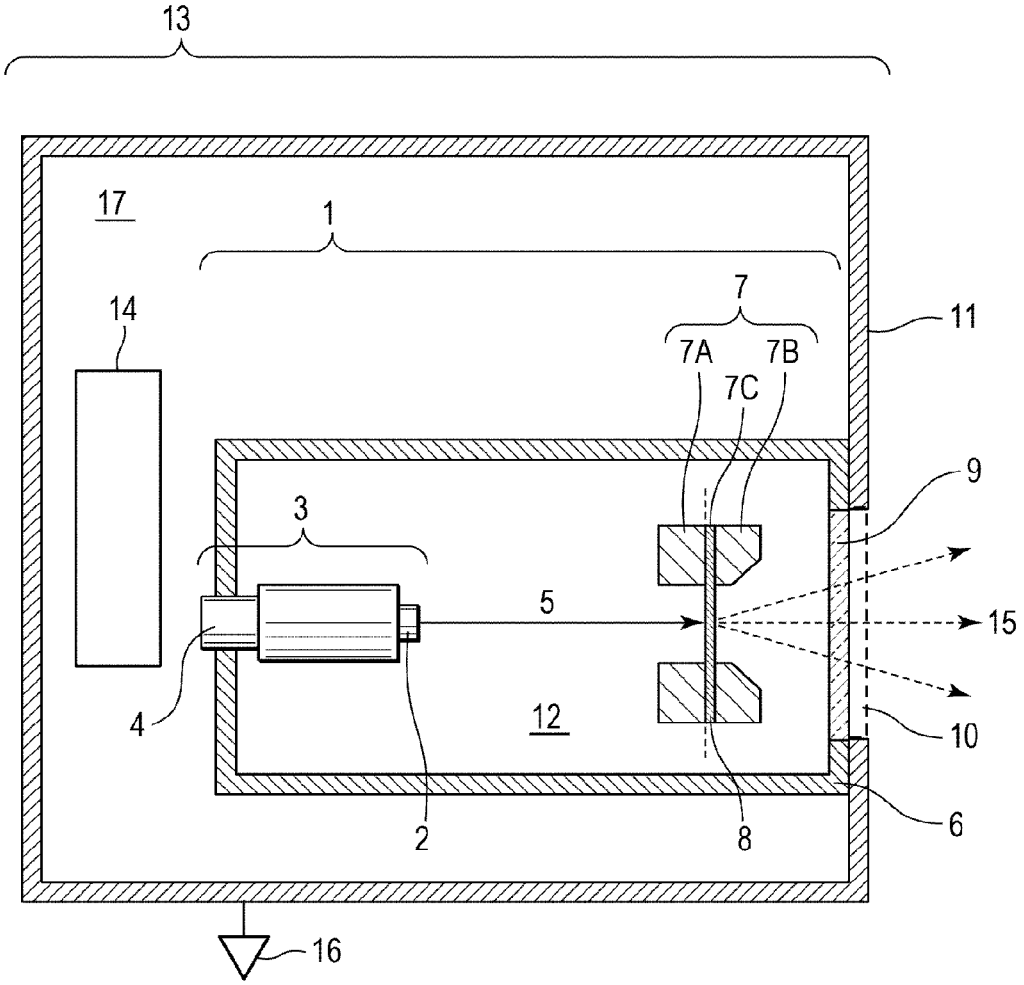
FIG. 1 is a cross-sectional view of an X-ray emitting device according to the present invention.

A configuration example of an X-ray emitting device according to the present invention will be described with reference to FIG. 1.

The X-ray emitting device 13 includes a housing 11 having an emission window 10, an X-ray emission source 1, and a drive circuit 14. The X-ray emission source 1 includes an envelope 6 having an X-ray transmission window 9. The inside of the envelope 6 is a decompressed (vacuumed) internal space 12. The internal space 12 may have a degree of vacuum at which an electron can fly at least a distance between an electron emission source 3 described later and an X-ray emitting target 8 (hereinafter abbreviated to a target) as an electron mean free path. The degree of vacuum may be 1E-4 Pa or less. The degree of vacuum can be arbitrarily selected considering an electron emission source to be used, an operating temperature, and the like. When a cold cathode electron emission source is used, it is more preferable to set the degree of vacuum to 1E-6 Pa or less. In order to maintain the degree of vacuum, it is possible to install a getter (not shown in FIG. 1) in the internal space 12 or in an auxiliary space (not shown in FIG. 1) connected to the internal space 12.

The electron emission source 3 disposed in the envelope 6 may be an electron emission source whose emission amount of electrons can be controlled from outside the envelope 6. A hot cathode electron emission source or a cold cathode electron emission source can be arbitrarily used as the electron emission source 3. The electron emission source 3 is electrically connected to the drive circuit 14 installed outside the envelope 6 so that the amount of emission electrons and an on/off state of electron emission can be controlled via a current introduction terminal 4 disposed to penetrate the envelope 6. The electron emission source 3 includes an electron emission unit 2. The electrons emitted from the electron emission unit 2 become an electron beam 5 having energy of 100 keV to 200 keV by an extraction grid and an acceleration electrode (not shown in FIG. 1) and can enter the target 8 disposed to face the electron emission unit 2. The extraction grid and the acceleration electrode can be embedded in an electron gun tube of a hot cathode. It is possible to dispose a correction electrode for adjusting an irradiation spot position of the electron beam and astigmatism of the electron beam in the electron emission source 3 and connect the correction electrode to a correction circuit (not shown in FIG. 1) disposed inside or outside the housing 11. The housing 11 is desired to be set to a predetermined potential and the housing 11 can be grounded via a grounding terminal 16.

Next, the target 8 will be described with reference to FIGS. 1 and 2. The target 8 is disposed in a vacuum atmosphere in the envelope 6 and disposed at a position where the electron beam 5 from the electron emission source 3 can enter one surface of the target 8. The target 8 is formed by a target material including heavy elements. X-rays are generated in a process in which electrons of the incident electron beam lose kinetic energy in the target material. Specifically, an area of "electron penetration length multiplied by electron beam spot" in the target material is the X-ray generation area and X-rays are emitted in all directions from the X-ray generation area. In the X-ray emission source 1 of the present invention, an X-ray component of the generated X-rays, which is emitted from the reverse surface of the electron incident surface, is used.

The target 8 is fixed to a target holding unit 7. The electron emission source 3, the target 8, and an emitted X-ray extraction section (the transmission window 9 and the emission window 10) are arranged so that the centers of these are aligned on the same straight line. Further, the target holding unit 7 can double as an electrical connection mechanism for setting the target to a predetermined potential so that the accelerated electron beam 5 enters the target 8. Therefore, the target holding unit 7 is desired to be formed of a material having heat resistance for maintaining stable positioning performance and electrical conductivity for maintaining electrical connection performance even when the temperature of the target portion varies. Further, the target holding unit 7 can include an aperture mechanism, that is, an X-ray shielding function, which defines an externally extracted component 15 of the emitted X-rays. Therefore, the target holding unit 7 is further desired to have heat resistance, electrical conductivity, and high specific gravity for shielding the X-rays. For example, heavy metals such as molybdenum, tantalum, and tungsten, that is, metals of atomic number of 30 or more, can be used for the target holding unit 7.

The target holding unit 7 has a target holding surface 7C that defines the position of the target 8 and a relative angle to the electron emission source. Further, the target holding unit 7 has a portion protruding from the target holding surface 7C toward the electron emission source 3 and this portion is referred to as a rear target holding unit 7A. Further, the target holding unit 7 has a portion protruding from the target holding surface 7C toward the emission window 10 and this portion is referred to as a front target holding unit 7B. When the rear target holding unit 7A is formed of a high specific gravity material, it is possible to limit the emission range of reflection electrons generated in the target 8 and X-rays emitted toward the electron emission source 3. Similarly, when the front target holding unit 7B is formed of a high specific gravity material, it is possible to limit the emission range of X-rays generated in the target 8 and emitted toward the X-ray transmission window 9. Compared with a case in which a high specific gravity material is provided to the housing 11 and the envelope 6 which are located apart from the target 8 and whose heights are high, a case in which a high specific gravity material is provided to the target holding unit 7B which is located nearer the target 8 has an effect for suppressing increase in the weight of the entire X-ray emitting device and has an advantage in weight saving.

The target 8 will be described in more detail with reference to FIG. 2. The target 8 includes a diamond substrate 80, a first layer 81 including a metal where the standard free energy of formation of carbide in a temperature range from 500 degrees Celsius to 1500 degrees Celsius is negative, and a second layer 82 including a metal whose atomic number is 42 or more, which are laminated in this order.

The diamond substrate 80 includes at least a surface (inner surface) to which the first layer 81 and the second layer 82 are provided, a surface (outer surface) which is the reverse surface of the inner surface and from which the X-rays are extracted, and side surfaces for connecting to the target holding unit 7. The thickness (the distance between the inner surface and the outer surface) of the diamond substrate 80 is desired to be substantially constant within the surfaces in order to uniformize the transmittance distribution of the X-rays. The diamond substrate 80 can have a cylindrical shape (disk shape) or a flat plate shape. It is possible to determine the upper limit of the thickness of the diamond substrate 80 from the viewpoint of the transmittance of the X-rays and determine the lower limit of the diamond substrate 80 from the viewpoint of the heat transfer properties and the strength. The diamond substrate 80 having a thickness from 50 micrometer to 2000 micrometer can be used. More preferably, the diamond substrate 80 having a thickness from 350 micrometer to 1200 micrometer can be used. Although the diamond substrate 80 may be any of a single crystal body, a polycrystalline body, and an amorphous body such as a diamond-like carbon (DLC), the diamond substrate 80 is desired to be a single crystal body from the viewpoint of thermal conductivity. A method for manufacturing the diamond substrate 80 can be any of a chemical vapor deposition (CVD) method, a sintered body formation method, and a high pressure synthesis method in which the diamond substrate 80 is synthesized using a seed crystal, a carbon raw material, and a catalytic metal under high pressure. Although the method is not particularly limited, the high pressure synthesis method is desired to be used from the viewpoint of securing the thickness, the thermophysical property, and the degree of purity.

Next, the second layer 82 will be described. As a second metal included in the second layer 82, a material having high specific gravity is used to efficiently convert incident electrons into X-rays. Specifically, the second layer 82 includes a metal whose atomic number is 42 or more. For example, tungsten, ruthenium, platinum, iridium, and tantalum can be used. An area where electrons are converted into X-rays is also an area where heat is generated and a local heat generation spot occurs in a range of the electron penetration length in the layer thickness direction. The second layer 82 formed of a material having high thermal conductivity has an advantage in heat transfer properties to the target holding unit 7 which is colder than the heat generating portion, so that it is possible to alleviate overheating of an electron irradiation spot 53. In particular, the tungsten has a high melting point of 3380 degrees Celsius and the tungsten is a material having high thermal conductivity larger than 100 W/mK in a wide temperature range, so that the tungsten is one of more desired materials. The film thickness of the second layer 82 can be selected from the viewpoint of the amount of generation, the amount of attenuation, and the radiation quality of the X-rays, the acceleration voltage of the electrons, and the heat transfer to the target holding unit. For example, the thickness can be selected from a range between 1 micrometer and 15 micrometer. When using electrons accelerated by a higher voltage, the film thickness of the second layer 82 can be larger than the electron penetration length. However, when a bremsstrahlung component is desired to be more dominant than a characteristic radiation component, the film thickness of the second layer 82 can be smaller than the electron penetration length. A method for forming the second layer 82 is not limited to a specific method if the adhesion to the diamond substrate and the first layer is secured. Sputtering, CVD, vapor deposition, and the like can be used as the method for forming the second layer 82.

Next, the first layer 81 will be described. Diamond is excellent as the diamond substrate and the transmission window of the X-rays from the viewpoint of high thermal conductivity, high thermostability, and low specific gravity. However, the affinity between diamond and various metal materials having a high specific gravity which can be applied to the target material is low, so that there is an adhesion problem that a film is peeled when a film of the target metal (the second layer 82) is formed and when an X-ray emitting operation is performed. The first layer 81 is disposed between the diamond substrate 80 and the second layer 82 as an adhesion layer in order to improve the adhesion problem. The first layer 81 includes a first metal that forms a carbide with diamond, so that the first layer 81 can secure the adhesion to the diamond layer. The first layer 81 is formed of a material where the standard free energy of formation of carbide is negative. The standard free energy of formation of carbide is a free energy change when the carbide is generated from a single body (metal). The standard free energy of formation of carbide generally has temperature characteristic. The temperature range concerning the standard free energy of formation of carbide in the present invention is 500 degrees Celsius to 1500 degrees Celsius considering the operating temperature of the target and the melting point of the metal included in the second layer. The standard free energy of formation of the carbide in the first layer of the present invention is preferred to be negative because it is possible to obtain an anchoring effect between the first layer 81 and the diamond substrate 80. It is more preferable that the standard free energy of formation of the carbide in the first layer of the present invention is 40 kJ/mol degree Celsius or less because when the standard free energy of formation of the carbide is 40 kJ/mol degree Celsius or less, it is possible to obtain a sufficient anchoring effect between the first layer 81 and the diamond substrate 80 even when the layer thickness of the first layer 81 is thin. Further, it is more preferable that the metal included in the second layer and the metal included in the first layer form a solid solution because a high affinity between the first layer 81 and the second layer 82 can be used. From the same viewpoint, it is more preferable that the metal included in the second layer and the metal included in the first layer are in a relationship of complete solid solution.

Specifically, when the second layer 82 is formed of tungsten, if titanium, vanadium, tantalum, or chromium is applied as the first layer 81, metallic elements included in the second layer 82 and metallic elements included in the first layer 81 can form a solid solution at an arbitrary composition ratio. As described above, a continuous metal density distribution is formed on an interface between the layers formed of materials that can form a solid solution at an arbitrary composition ratio, so that the two layers can be firmly and closely adhered to each other at the interface thereof.

Further, an embodiment of the present invention includes that the metal elements included in the first layer 81 satisfy that the standard free energy of formation of carbide in the temperature range between 500 degrees Celsius and 1500 degrees Celsius is negative, so that it is possible to secure the adhesion between the first layer 81 and the diamond substrate 80. Further, titanium, vanadium, tantalum, or chromium is applied as the first layer 81, so that the metal elements included in the first layer 81 satisfy that the standard free energy of formation of carbide in the temperature range between 500 degrees Celsius and 1500 degrees Celsius is 40 kJ/mol degree Celsius or less and it is possible to further secure the adhesion between the first layer 81 and the diamond substrate 80. Further, titanium or tantalum is applied as the first layer 81, so that the metal elements satisfy that the standard free energy of formation of carbide is 100 kJ/mol degree Celsius or less and it is possible to further more secure the adhesion between the first layer 81 and the diamond substrate 80. A method for forming the first layer 81 is not limited to a specific method if the adhesion to the diamond substrate 80 and the second layer 82 is secured. Various film forming methods such as Sputtering, CVD, and vapor deposition can be used as the method for forming the first layer 81.

Next, a preferable range of the film thickness of the first layer 81 will be described. Although the first metals included in the first layer 81 are excellent in adhesion as described above, as shown in Table 1, the thermal conductivity of these metals is not necessarily higher than that of tungsten suitable for the second layer 82.

TABLE 1

| | Titanium | Vanadium | Tantalum | Chromium | Tungsten (second layer) |
|---|---|---|---|---|---|
| Thermal conductivity (W/mK) | 14/13 | 36.8 | 54/60.2 | 76.2/67.4 | 121 |
| Temperature (degrees Celsius) | 400/600 | 500 | 100/627 | 426/760 | 500 |

Figure 5A:
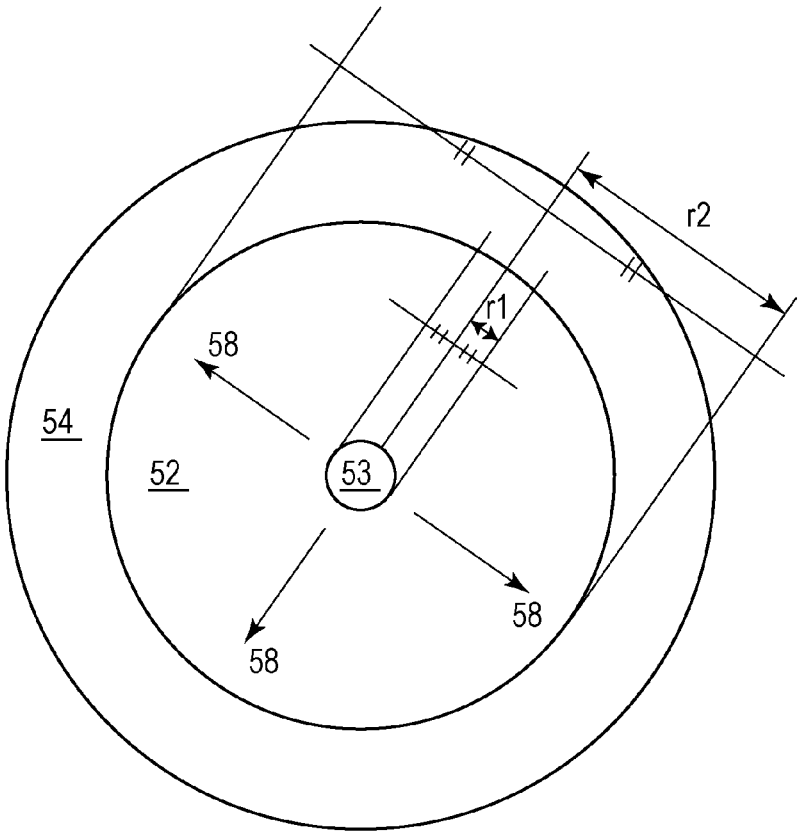
FIG. 5A is an illustration for explaining a heat transfer path of the X-ray emitting target according to the present invention.
Figure 5B:
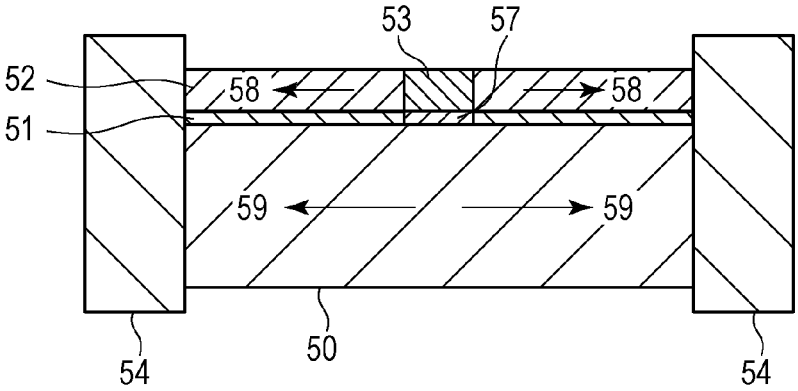
FIG. 5B is an illustration for explaining a heat transfer path of the X-ray emitting target according to the present invention.

Therefore, if the layer thickness of the first layer 81 is too large, heat transfer from the heat generating portion to the diamond substrate 80 is interrupted. The heat transfer from the heat generating portion in the second layer 82 will be specifically described with reference to FIG. 5. FIGS. 5A and 5B are illustrations for explaining a heat transfer path. FIG. 5A is a top view and FIG. 5B is a cross-sectional view corresponding to the top view. A first layer 51 having a layer thickness $t_1$ and a second layer 52 having a layer thickness $t_2$ are laminated on a diamond substrate 50 having a thickness $t_0$ and a disk shape of radius $r_2$ so that each layer covers the layer below including the circumferential portion thereof. The laminated target is fixed by a target holding unit 54 at the circumferential portion of each layer. A high temperature portion corresponding to the electron irradiation spot in the second layer is shown as a heating portion 53 of the first layer. The heating portion 53 is shown as a circle of radius $r_1$ which is concentric with the outer circumferential circle of the second layer 82. Here, let us consider the heat transfer from the heating portion 53 to a low temperature portion (target holding unit) 54. The thermal conductivities of the diamond substrate 50, the first layer 51, and the second layer 52 are defined as $lambda_0$, $lambda_1$, and $lambda_2$ respectively.

The heat transfer rate $K_1$ of a heat flow path through which heat flows from the heating portion 53 in the second layer 52 to the diamond substrate 50 via the heat transfer path in the first layer immediately below the heating portion 53 is obtained by Formula 1.

[Math. 1]

$$\kappa_1 = \frac{\lambda_1 \pi (r_1)^2}{t_1} \quad \text{Formula 1}$$

The heat transfer rate $K_2$ of a heat flow path 58 through which heat is radially transferred from the heating portion 53 in the second layer 52 in the film surface direction to the low temperature portion 54 is obtained by Formula 2.

[Math. 2]

$$\kappa_2 = \frac{2\pi (t_2)\lambda_2}{ln\left(\frac{r_2}{r_1}\right)} \quad \text{Formula 2}$$

The heat transfer rate $K_0$ of a heat flow path 59 through which heat received from the first layer 51 by the diamond substrate 50 at the center of the diamond substrate 50 is radially transferred from the center of the diamond substrate 50 in the substrate surface direction to the low temperature portion 54 is obtained by Formula 3.

[Math. 3]

$$\kappa_0 = \frac{2\pi (t_0)\lambda_0}{ln\left(\frac{r_2}{r_1}\right)} \quad \text{Formula 3}$$

Here, a condition that satisfies a continuous heat flow relation of the heat flow paths 57, 58, and 59 and a condition that the heat flow path 57 does not become a bottleneck (a narrow or obstructed section, where movement is slowed down) of heat transfer from the heating portion 53 to the diamond substrate 50 are represented by Formula 4.

[Math. 4]

$$(\kappa_0^{-1}+\kappa_1^{-1})^{-1} \geq \kappa_2 \quad \text{Formula 4}$$

The substrate is formed of diamond having high thermal conductivity $lambda_0$, so that the relationship between the thermal conductivity $lambda_0$ and the thermal conductivity $lambda_1$ of the second layer 52 satisfies Formula 5.

[Math. 5]

$$\lambda_0 >> \lambda_1 \quad \text{Formula 5}$$

When considering and organizing the relationship $t_0 > t_2$ between the thickness $t_0$ of the diamond substrate 50 and the thickness $t_2$ of the second layer 52, the relationship $lambda_0 > lambda_2$ between the thermal conductivity $lambda_0$ of the diamond substrate 50 and the thermal conductivity $lambda_2$ of the second layer 52, and the relationship of the thermal conductivities $K_0 >> K_2$, which is obvious from the Formula 2 and Formula 3, the upper limit of the thickness $t_1$ of the first layer 51 is defined by the shapes and the thermal conductivities of the first layer 51 and the second layer 52 and represented by Formula 6.

[Math. 6]

$$t_1 \leq \frac{1}{2}\frac{1}{t_2}(r_1)^2 \frac{\lambda_1}{\lambda_2} ln(r_2/r_1) \quad \text{Formula 6}$$

Formula 6 has a technical meaning that resolves the thermal bottleneck of the first layer 51 and enables the diamond substrate 50 having higher thermal conductivity to be a dominant heat transfer path. For example, Formula 6 means that it is possible to resolve the thermal bottleneck of the first layer 51 by further reducing the upper limit of the layer thickness of the first layer 51 when the layer thickness of the second layer 52 is large. By doing so, even when the electron irradiation density to the target metal layer (the second layer 52) increases, it is possible to obtain an effect that the overheating of the heating portion 53 in the second layer 52, which is an X-ray emission spot, can be alleviated.

The inventors found that, when the layer thickness $t_1$ of the first layer 51 satisfies Formula 6 and further the layer thickness $t_1$ of the first layer 51 is within a range greater than or equal to 0.1 nm and smaller than or equal to 100 nm, it is possible to provide an X-ray emitting target and an X-ray emitting device which secure linearity and output stability during an X-ray emitting operation. Further, the inventors found that, when the layer thickness of the first layer 51 is greater than or equal to 1 nm and smaller than or equal to 10 nm, it is possible to secure higher output stability during the X-ray emitting operation.

Figure 2:
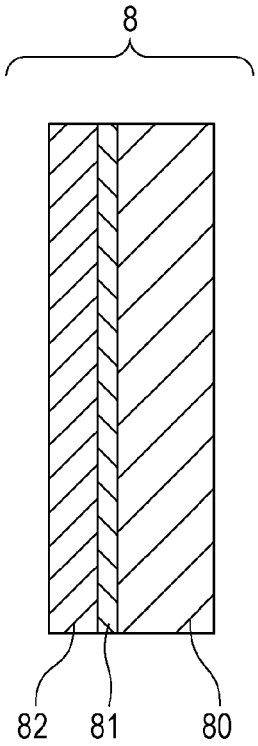
FIG. 2 is a cross-sectional view of an X-ray emitting target according to the present invention.
Figure 3A:
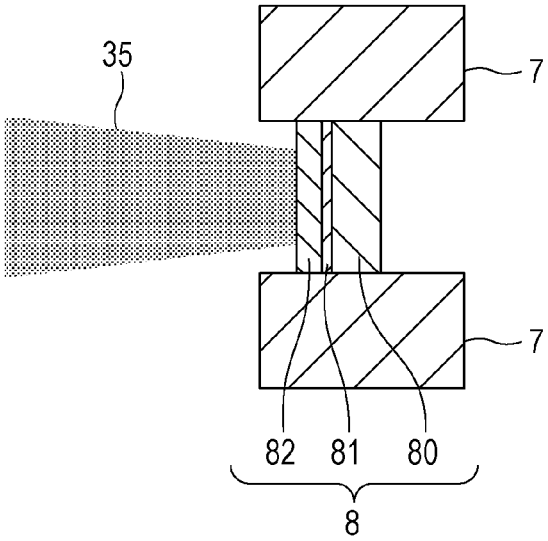
FIG. 3A is a cross-sectional view of another X-ray emitting target according to the present invention.
Figure 3B:
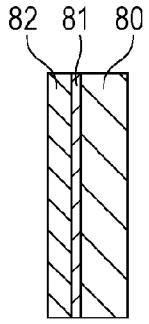
FIG. 3B is a cross-sectional view of another X-ray emitting target according to the present invention.
Figure 3C:
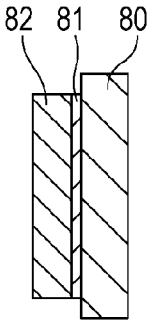
FIG. 3C is a cross-sectional view of another X-ray emitting target according to the present invention.
Figure 3D:
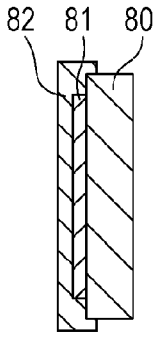
FIG. 3D is a cross-sectional view of another X-ray emitting target according to the present invention.

The shape of the lamination of the first layer 81 and the second layer 82 with respect to the diamond substrate 80 is not limited to the shape which covers the entire one side of the diamond substrate 80 as shown in FIG. 2, but includes various covering shapes as shown in FIGS. 3B to 3D. How much of the first layer 81 and the second layer 82 is covered can be determined considering the irradiation range of an electron beam 35 and the electrical connection with the target holding unit 7 as shown in FIG. 3A. As a method for fixing the target 8 of the present invention to the target holding unit 7, it is possible to use a method using a conductive connection member such as silver solder not shown the drawings or a pressure bonding method.

The shape of the X-ray emitting unit including the target holding unit 7 and the target 8 is not limited to the shape shown in FIG. 1, but the X-ray emitting unit can have various shapes as shown in FIGS. 4A to 4D. The shape by which the target holding unit 7 holds the target 8 can be appropriately determined considering the electrical connection to the target 8, the range in which reflection electrons reflected by the second layer 82 of the target 8 reach, and the emission ranges of the emitted X-rays and backscattering X-rays.

The present invention includes not only that a single electron emission source 3 and a single X-ray emitting target 8 are arranged for the X-ray emitting device 13 and the X-ray emission source 1 as shown in FIG. 1, but also that a plurality of electron emission sources 3 and a plurality of X-ray emitting targets 8 are arranged.

A potential relationship between the electron emission source 3 and the X-ray emitting target 8 can be arbitrarily selected based on the potential of the housing 11, the type of the power supply circuit, and the like. The potential relationship between the electron emission source 3 and the X-ray emitting target 8 may be determined so that the accelerated electron beam 5 can enter the target 8 with a predetermined kinetic energy. For example, it is possible to determine the potential relationship so that the acceleration electrode of the electron emission source 3 is grounded and the electron emission unit (cathode) 2 is set to negative potential with respect to the ground potential, or it is also possible to determine the potential relationship so that an arbitrary potential between the electron emission unit 2 and the acceleration electrode is grounded, the acceleration electrode is set to positive potential, and the potential of the electron emission unit 2 is set to negative potential.

EXAMPLE 1

Figure 4A:
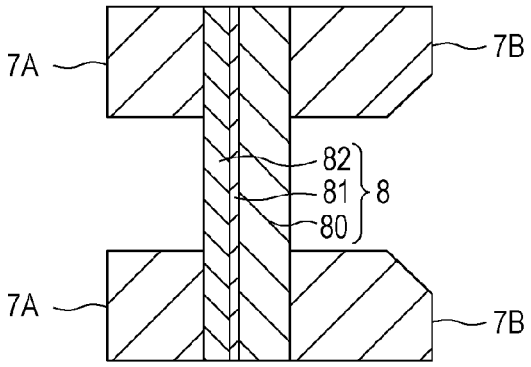
FIG. 4A is a cross-sectional view of an X-ray emitting unit according to the present invention.
Figure 4B:
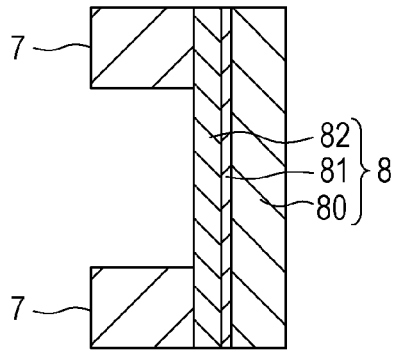
FIG. 4B is a cross-sectional view of an X-ray emitting unit according to the present invention.
Figure 4C:
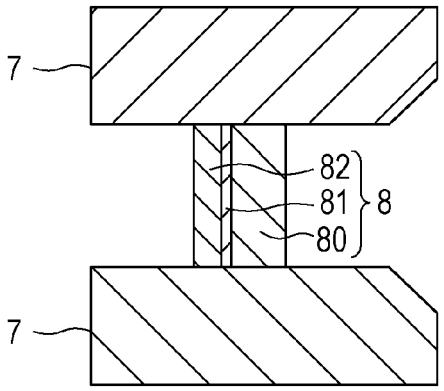
FIG. 4C is a cross-sectional view of an X-ray emitting unit according to the present invention.
Figure 6:
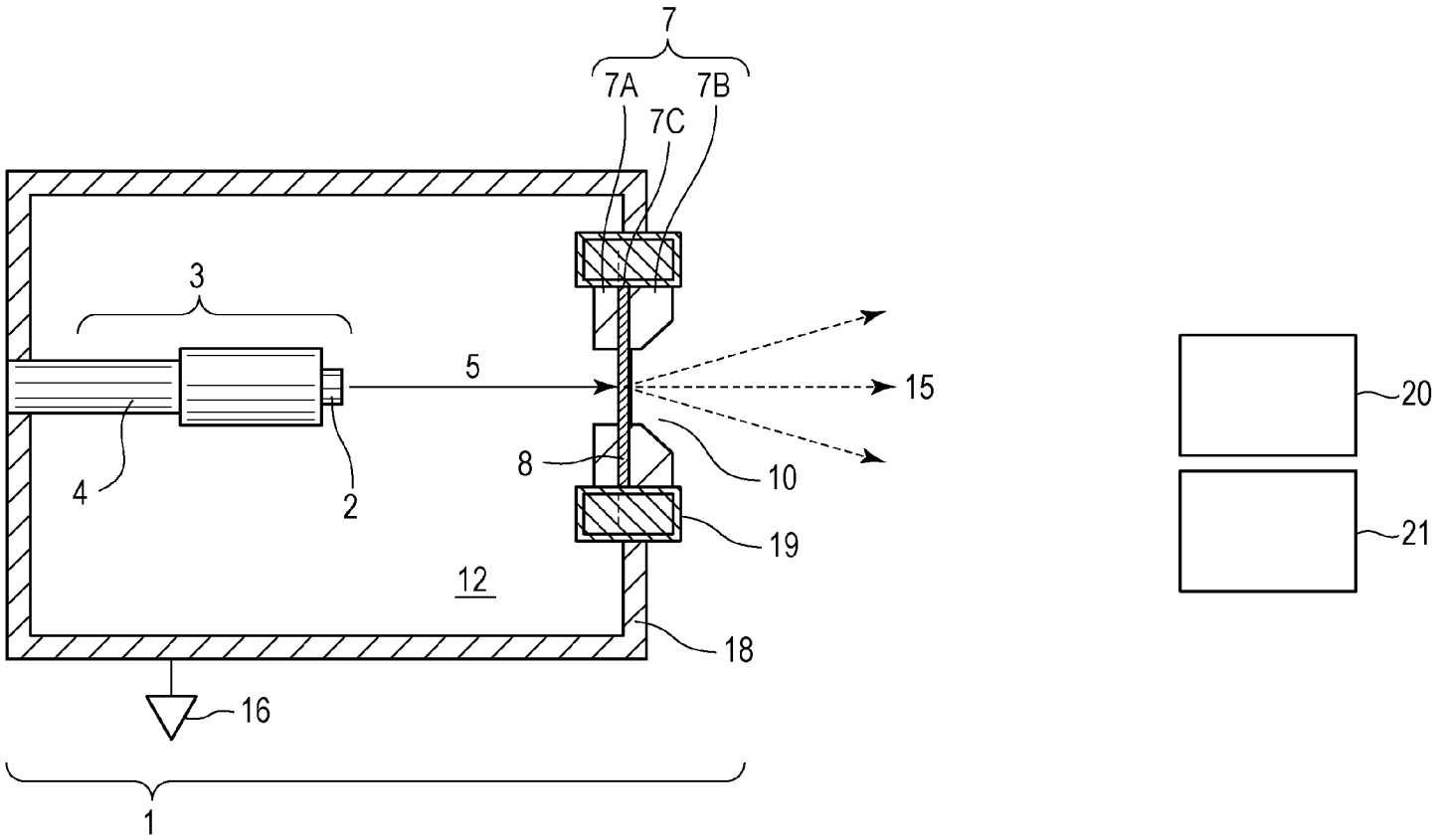
FIG. 6 is a block diagram of an experimental device according to the present invention.

Example 1 will be described in detail with reference to FIGS. 2, 4B, and 6.

First, a high-pressure synthesized diamond manufactured by Sumitomo Electric Industries, Ltd. is prepared as the diamond substrate 80. The diamond substrate 80 has a disk shape (a cylindrical shape) with a diameter of 5 mm and a thickness of 1 mm. The thermal conductivity of the diamond substrate 80 at room temperature is 2000 W/mK. Organic substances on the surface of the diamond substrate 80 are removed in advance by UV-ozone asher.

The first layer 81 of titanium having a thickness of 10 nm is formed on one surface of two circular surfaces with a diameter of 1 mm of the diamond substrate by a sputtering method using Ar as carrier gas. The substrate is heated so that the temperature of the diamond substrate is 260 degrees Celsius when the titanium film is formed. Next, the second layer 82 of tungsten having a thickness of 8 micrometer is formed on the first layer 81 by a sputtering method using Ar as carrier gas by continuous deposition without venting atmosphere in a film forming device. The substrate is heated by a stage so that the temperature of the diamond substrate 80 is 260 degrees Celsius when the tungsten film is formed in the same manner as when the titanium film is formed. The thermal conductivity of each layer is evaluated using a monitor substrate prepared in advance in the film forming process. As a result, the thermal conductivity of the first layer is 16 W/mK and the thermal conductivity of the second layer is 178 W/mK.

Regarding the thicknesses of the first layer 81 and the second layer 82, before the layers are laminated, calibration curve data of a film thickness and a film forming time when a single layer film is formed is obtained for each layer in advance, and the first layer 81 and the second layer 82 are laminated so that films having selected film thicknesses are formed based on the film forming times. The film thicknesses for obtaining the calibration curve data are measured using a spectroscopic ellipsometer UVISEL ER manufactured by Horiba, Ltd.

A cross-section of the obtained target 8 is mechanically polished and processed by FIB, so that a cross-section analyte S1 including interfaces between the second layer 82, the first layer 81, and the diamond substrate 80 is prepared. Distribution of composition and combination of the prepared analyte S1 is mapped by X-ray photoelectron spectroscopy (XPS) and it is found that there is a combination of titanium and carbon at the boundary between an area where titanium is dominant, which corresponds to the first layer 81, and an area where carbon is dominant, which corresponds to the diamond substrate 80. A cross-section of the obtained target 8 is processed by FIB, so that an analyte S2 to be observed by a transmission electron microscope (TEM) is prepared in the same manner as the analyte S1. Thereafter, crystalline distribution, crystal orientation distribution, and composition distribution are evaluated by combining a bright-field image observation, an electron diffraction analysis (ED), and an electron spectroscopy analysis of the transmission electron microscope. The obtained crystal orientation distribution is mapped. As a result, it is found that a solid solution of tungsten and titanium is formed in a transition area between an area where tungsten is dominant, which corresponds to the second layer 82 and an area where titanium is dominant, which corresponds to the first layer 81. In this way, as shown in FIG. 2, the target 8 is obtained in which the diamond substrate 80, the first layer 81 formed of titanium, and the second layer 82 formed of tungsten are laminated in this order. Next, the target 8 is sandwiched and held by the target holding unit 7 formed of tungsten including the rear target holding unit 7A and the front target holding unit 7B. Further, as shown in FIG. 4A, the target 8 is fixed so that the second layer 82 is in contact with the rear target holding unit 7A by using silver solder (not shown in the drawings) as a connection layer.

Next, a unit (X-ray emitting unit), which includes the target 8 and the target holding unit 7, and the electron emission source 3, which is an impregnated type thermal-electron gun including the electron emission unit 2, are disposed to face each other so that the second layer 82 and the electron emission unit 2 face each other directly. Further, as shown in FIG. 6, the X-ray emitting unit and the electron emission source 3 are disposed in a vacuum chamber 18 including a flange 19. The target holding unit 7 is fixed to the vacuum chamber 18 via the flange 19. The target 8 is connected to the vacuum chamber 18 via target holding unit 7 and the flange 19 so that the target 8 is electrically conductive to the vacuum chamber 18. Further, the potential of the vacuum chamber 18 is set to the ground potential by the ground terminal 16 connected to the vacuum chamber 18. The potential of the cathode of the electron emission source 3 is set to −120 kV by a power supply circuit not shown in the drawings, so that the electron emission source 3 can irradiate the electron beam 5 having a kinetic energy of 120 keV to the center of the second layer 82 of the target 8. A copper cooling pipe (not shown in the drawings) in which water flows is disposed along the circumferential portion of the electron emission source 3 and the circumferential portion of the rear target holding unit 7A, so that the electron emission source 3, the target 8, and the target holding unit 7 can be cooled down when the X-ray output operation is performed.

Next, two types of dosimeters (20, 21) are replaceably arranged at a position on an extended line connecting the electron emission source 2 and the center of the target 8 having a disk shape and 100 cm away from the surface of the diamond substrate 80 facing the air. One dosimeter 20 is a dosimeter using an ionization chamber method, which is arranged to measure a time-integrated value of the dose. The other dosimeter includes a semiconductor detector and is arranged to measure the time variation of the dose. The density of the current emitted from the electron emission source 3 is changed and linearity of X-ray dose with respect to the electron irradiation amount is measured by the dosimeter 20. Further, after electrons are continuously emitted from the electron emission source 3 for 0.1 sec, 1 sec, and 3 sec, the time variation in one second of the center value of the intensity of the dose detected by the dosimeter 21 is measured. When the electrons are emitted, the electrons are focused onto the surface of the second layer 82 on the vacuum side. The spot radius of the electron beam 5 is 0.5 mm. The evaluation results are shown in Tables 2 and 3. In both evaluations of linearity and stability, a current flowing from the second layer 82 to the ground electrode is detected and the variation of the current density flowing through the second layer 82 is controlled to be 1% or less by a negative feedback circuit not shown in the drawings.

TABLE 2

| | Detection by dosimeter 20 | | |
|---|---|---|---|
| Current density (mA/mm$^2$) | 5 | 10 | 20 |
| Relative intensity of detected dose | 1 | 2.01 | 3.96 |
| Linearity evaluation | Norm | OK | OK |

TABLE 3

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.3% | 2.4% | 2.5% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition. (Among the X-ray output characteristic results of the present example and the other examples, "OK" in Tables 2, 4, 6, 8, 10, 12, and 14 showing the linearity evaluation result indicates that there is no problem in the linearity evaluation result. Further, "OK" in Tables 3, 5, 7, 9, 11, 13, and 15 showing the output stability evaluation result indicates that there is no problem in the output stability evaluation result.)

EXAMPLE 2

In the same manner as in Example 1 except that the layer thickness of the first layer 81 is 1 nm and the layer thickness of the second layer 82 is 7 micrometer, the linearity of the X-ray output intensity with respect to the electron irradiation amount and the stability of the X-ray output intensity in a high dose electron irradiation condition are evaluated. The evaluation results are shown in Tables 4 and 5.

TABLE 4

| | Detection by dosimeter 20 | | |
|---|---|---|---|
| Current density (mA/mm$^2$) | 5 | 10 | 20 |
| Relative intensity of detected dose | 1 | 2.02 | 3.99 |
| Linearity evaluation | Norm | OK | OK |

TABLE 5

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.3% | 2.3% | 2.4% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition.

EXAMPLE 3

In the same manner as in Example 1 except that the layer thickness of the first layer 81 is 100 nm and the layer thickness of the second layer 82 is 5.5 micrometer, the linearity of the X-ray output intensity with respect to the electron irradiation amount and the stability of the X-ray output intensity in a high dose electron irradiation condition are evaluated. The evaluation results are shown in Tables 6 and 7.

TABLE 6

| | Detection by dosimeter 20 | | |
|---|---|---|---|
| Current density (mA/mm$^2$) | 5 | 10 | 20 |
| Relative intensity of detected dose | 1 | 1.99 | 3.95 |
| Linearity evaluation | Norm | OK | OK |

TABLE 7

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.5% | 2.8% | 2.9% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition.

EXAMPLE 4

In the same manner as in Example 1 except that the layer thickness of the first layer 81 is 0.1 nm and the layer thickness of the second layer 82 is 5.6 micrometer, the linearity of the X-ray output intensity with respect to the electron irradiation amount and the stability of the X-ray output intensity in a high dose electron irradiation condition are evaluated. The evaluation results are shown in Tables 8 and 9.

TABLE 8

| | Detection by dosimeter 20 | | |
|---|---|---|---|
| Current density (mA/mm$^2$) | 5 | 10 | 20 |
| Relative intensity of detected dose | 1 | 1.99 | 3.98 |
| Linearity evaluation | Norm | OK | OK |

TABLE 9

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.5% | 2.7% | 2.8% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition.

EXAMPLE 5

In the same manner as in Example 1 except that the first layer 81 is a tantalum film formed by sputtering and the layer thickness of the first layer 81 is 100 nm, the linearity of the X-ray output intensity with respect to the electron irradiation amount and the stability of the X-ray output intensity in a high dose electron irradiation condition are evaluated. The thermal conductivity of the first layer 81 formed of tantalum at room temperature is 58 W/mK. The evaluation results are shown in Tables 10 and 11.

TABLE 10

| | Detection by dosimeter 20 | | |
|---|---|---|---|
| Current density (mA/mm$^2$) | 5 | 10 | 20 |
| Relative intensity of detected dose | 1 | 1.99 | 4.01 |
| Linearity evaluation | Norm | OK | OK |

TABLE 11

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.2% | 2.2% | 2.4% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition.

In the same manner as in Example 1, distribution of composition and combination of the interface between the first layer 81 and the diamond substrate 80 is analyzed by XPS and it is found that there is a combination of tantalum and carbon at the boundary between an area where tantalum is dominant, which corresponds to the first layer 81, and an area where carbon is dominant, which corresponds to the diamond substrate 80. Further, in the same manner as in Example 1, crystalline distribution, crystal orientation distribution, and composition distribution are evaluated by combining the bright-field image observation, the electron diffraction analysis (ED), and the electron spectroscopy analysis of the transmission electron microscope. The obtained crystal orientation distribution is mapped. As a result, it is found that a solid solution of tungsten and tantalum is formed in a transition area between an area where tungsten is dominant, which corresponds to the second layer 82 and an area where tantalum is dominant, which corresponds to the first layer 81.

EXAMPLE 6

In the same manner as in Example 1 except that the first layer 81 is a tantalum film formed by sputtering and the layer thickness of the first layer 81 is 1 nm, the linearity of the X-ray output intensity with respect to the electron irradiation amount and the stability of the X-ray output intensity in a high dose electron irradiation condition are evaluated. The evaluation results are shown in Tables 12 and 13.

TABLE 12

| | Detection by dosimeter 20 | | |
|---|---|---|---|
| Current density (mA/mm$^2$) | 5 | 10 | 20 |
| Relative intensity of detected dose | 1 | 1.99 | 3.99 |
| Linearity evaluation | Norm | OK | OK |

TABLE 13

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.1% | 2.2% | 2.4% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition.

EXAMPLE 7

The second layer 82 of the target 8 and the electron emission unit 2 are disposed to face each other in the same manner as in Example 1, and as shown in FIG. 1, the transmission window 9 formed of beryllium having a thickness of 1 mm is disposed and the target 8 and the electron emission source 3 of Example 1 are arranged in the envelope 6 formed of a ceramic of boron nitride. The target holding unit 7 is electrically connected to an electrode (not shown in the drawings) provided in advance in the envelope 6 formed of ceramic. The surface of the target 8 on which no film is formed faces the air side and the surface of the target 8 on which films are formed faces the vacuum side. The transmission window 9, the target 8, and the electron emission unit 2 are fixed so that the center of the transmission window 9, the center of the target 8, and the center of the electron emission unit 2 are aligned on the same straight line. Next, the internal space 12 of the envelope 6 is decompressed, so that a vacuum envelope 6 is formed. The potential of the electrode (not shown in the drawings) provided in the vacuum envelope 6 is set to the ground potential and the cathode of the electron emission source 3 is set to −120 kV, so that electrons having a kinetic energy of 120 keV can be irradiated to the center of the second layer 82 of the target 8. The X-ray emission source 1 including the vacuum envelope 6 and the drive circuit 14 that drives the electron gun are disposed in a housing internal space 17 of the housing 11 filled with insulating silicon oil, so that the X-ray emitting device 13 is completed. In the same manner as in Example 1, the linearity of the X-ray output intensity with respect to the electron irradiation amount and the stability of the X-ray output intensity in a high dose electron irradiation condition of the obtained X-ray emitting device 13 are evaluated. The evaluation results are shown in Tables 14 and 15. In both evaluations of linearity and stability, a current flowing from the second layer 82 to the ground electrode is detected and the variation of the current density flowing through the second layer 82 is controlled to be 1% or less by a negative feedback circuit not shown in the drawings.

TABLE 14

| | Detection by dosimeter 20 | | |
|---|---|---|---|
| Current density (mA/mm$^2$) | 5 | 10 | 20 |
| Relative intensity of detected dose | 1 | 1.98 | 3.95 |
| Linearity evaluation | Norm | OK | OK |

TABLE 15

| | Detection by dosimeter 21 | | |
|---|---|---|---|
| Current density (mA/mm$^2$) | 10 | 10 | 10 |
| Electron irradiation elapsed time t (min) | 0.1 | 1 | 3 |
| Variation rate of detected dose (%) | 2.5% | 2.4% | 2.5% |
| Stability evaluation | Norm | OK | OK |

In the present example, sufficient linearity and stability are observed in both evaluations of the linearity of the X-ray output intensity with respect to the electron irradiation amount and the stability of the X-ray output intensity in a high dose electron irradiation condition.

As described above, in the X-ray emitting target 8 obtained in any one of Examples 1 to 6 and the X-ray emitting device 13, sufficient linearity and stability are observed in both evaluations of the linearity of the X-ray output intensity with respect to the electron irradiation amount and the stability of the X-ray output intensity in a high dose electron irradiation condition.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-127513, filed Jun. 7, 2011, which is hereby incorporated by reference herein in its entirety.

REFERENCE SIGNS LIST

50, 80 Diamond substrate
51, 81 First layer
52, 82 Second layer
8 X-ray emitting target

The invention claimed is:

1. A transmitting type X-ray emitting device comprising:
a vacuum envelope, inside of which is decompressed;
an electron emission source disposed inside the vacuum envelope; and
a transmitting type X-ray emitting target comprising:
a diamond substrate;
a first layer disposed on the diamond substrate and including a first metal; and
a second layer disposed on the first layer and including a second metal whose atomic number is 42 or more and which has a thermal conductivity higher than that of the first metal,
wherein the electron emission source and the second layer are arranged to face each other,
wherein a thickness of the first layer and a thickness of the diamond substrate are greater than or equal to 1 nm and smaller than or equal to 10 nm, and greater than or equal to 350 micrometers and smaller than or equal to 2000 micrometers, respectively, such that an X-ray generated at the second layer is transmitted through the first layer and the diamond substrate, in that order, and is emitted from the diamond substrate, and
wherein a carbide of the first metal is present at a boundary between the diamond substrate and the first layer.

2. The transmitting type X-ray emitting device according to claim 1, wherein a solid solution of the first metal and the second metal is present at a boundary between the first layer and the second layer.

3. The transmitting type X-ray emitting device according to claim 1, wherein the first metal is any one of titanium, vanadium, tantalum, and chromium.

4. The transmitting type X-ray emitting device according to claim 1, wherein a standard free energy of formation of carbide of the first metal in a temperature range from 500 degrees Celsius to 1500 degrees Celsius is smaller than or equal to −40 kJ/mol degree Celsius.

5. The transmitting type X-ray emitting device according to claim 4, wherein the first metal is titanium or tantalum.

6. The transmitting type X-ray emitting device according to claim 1, wherein the second metal is tungsten.

7. A transmitting type X-ray emitting device comprising:
a vacuum envelope, inside of which is decompressed;
an electron emission source disposed inside the vacuum envelope; and
a transmitting type X-ray emitting target comprising:
a diamond substrate;
a first layer disposed on the diamond substrate and including a first metal where a standard free energy of formation of carbide in a temperature range from 500 degrees Celsius to 1500 degrees Celsius is negative; and
a second layer disposed on the first layer,
wherein the electron emission source and the second layer are arranged to face each other,
wherein a thickness of the first layer and a thickness of the diamond substrate are greater than or equal to 1 nm and smaller than or equal to 10 nm, and greater than or equal to 350 micrometers and smaller than or equal to 2000 micrometers, respectively, such that an X-ray generated at the second layer is transmitted through the first layer and the diamond substrate, in that order, and is emitted from the diamond substrate, and
wherein the second layer includes a second metal whose atomic number is 42 or more and which has a thermal conductivity higher than that of the first metal.

* * * * *